US008656680B2

(12) United States Patent
James

(10) Patent No.: US 8,656,680 B2
(45) Date of Patent: Feb. 25, 2014

(54) METHOD OF REINFORCING A STRUCTURE AND APPARATUS THEREFOR

(75) Inventor: Peter James, Newport Gwent (GB)

(73) Assignee: Cintec International Limited, Newport, Gwent (GB)

( * ) Notice: Subject to any disclaimer, the term of this patent is extended or adjusted under 35 U.S.C. 154(b) by 94 days.

(21) Appl. No.: 13/263,775

(22) PCT Filed: Apr. 7, 2010

(86) PCT No.: PCT/GB2010/050603

§ 371 (c)(1),
(2), (4) Date: Jan. 10, 2012

(87) PCT Pub. No.: WO2010/116188

PCT Pub. Date: Oct. 14, 2010

(65) Prior Publication Data

US 2012/0090895 A1 Apr. 19, 2012

(30) Foreign Application Priority Data

Apr. 8, 2009 (GB) ..... 0906125.0

(51) Int. Cl.
*E04B 1/00* (2006.01)
*E04G 21/00* (2006.01)
*E04G 23/00* (2006.01)

(52) U.S. Cl.
USPC ..... 52/742.16; 52/742.13; 405/259.5

(58) Field of Classification Search
USPC ..... 52/704, 707, 742.1, 742.13, 742.16; 405/259.1, 259.3, 259.5
See application file for complete search history.

(56) References Cited

U.S. PATENT DOCUMENTS

| | | | | |
|---|---|---|---|---|
| 5,497,841 | A * | 3/1996 | Cox et al. | 175/71 |
| 6,792,735 | B2 * | 9/2004 | Mohlenhoff | 52/742.16 |
| 2003/0167728 | A1 * | 9/2003 | Mohlenhoff | 52/742.16 |

FOREIGN PATENT DOCUMENTS

| | | | |
|---|---|---|---|
| DE | 2210226 | A1 | 9/1973 |
| DE | 2926155 | A1 | 8/1980 |
| EP | 1152102 | A2 | 11/2001 |
| WO | 2007144595 | A1 | 12/2007 |

* cited by examiner

*Primary Examiner* — Brian Glessner
*Assistant Examiner* — Brian D Mattei
(74) *Attorney, Agent, or Firm* — King & Schickli, PLLC

(57) ABSTRACT

Disclosed is a method of reinforcing a structure (10) having an elongate hole (14) or drilling the hole having an open proximal end (11) and a closed distal end (16). The method comprises the steps of inserting into the open end of the hole an elongate reinforcement core (20) carrying over at least part of its length an expandable sock (30), introducing a settable liquid (40), such as grout, into the sock at a first pressure so as to cause expansion of the sock toward the wall (18) of the hole (14), the sock being formed from a material which is permeable to the grout so as to allow the liquid to seep through the sock, reducing the pressure in the hole by means of a vacuum tube (23), whilst said introducing step is taking place, to at least a second pressure lower than the first pressure so as to encourage the grout to seep through the sock, to substantially fill the hole. The method also includes the step of ensuring that the vacuum tube extends substantially into the distal quarter of the length of the closed hole. Thus in embodiments of the invention, in producing a vacuum within the hole/drilling the seepage of the liquid or grout through the sock to make contact and bond with the wall of the drilling is increased along the whole length of the drilling.

13 Claims, 3 Drawing Sheets

16
24
42
20
22
18
22
14
30
10
B
B
23
28
11
32
36
26
25
24
12
44
40

Section
B–B
32
36
30
22
18
22
35
24
23
20
22
28
14
22

METHOD OF REINFORCING A STRUCTURE AND APPARATUS THEREFOR

This application is the national stage of PCT/GB2010/050603, field Apr. 7, 2010, which claims priority from British Patent Application Ser. No. 0906125.0, filed Apr. 8, 2009, the disclosures of which are incorporated herein by reference.

FIELD OF THE INVENTION

This invention relates to the reinforcing of structures particularly those of brick, masonry or concrete.

BACKGOURND OF THE INVENTION

It is a known technique to reinforce such a structure by drilling an elongate hole into it, inserting a rigid bar or rod covered in a fabric sock or sock, and injecting it with cementitious grout. The grout expands the sock under pressure to fill the space around the rod and some grout seeps through the fabric sock to bond to the wall of the drilling when set. Such a technique is described in EP1152102. The sock provides a restriction of the liquid grout to inhibit undesirable flow into cracks or cavities in the structure, other than the hole itself.

However, although the grout expands to fill the drilling, its seepage through the fabric sock is often not complete because the sock necessarily has to restrict the flow grout.

The result of the incomplete seepage of the grout through the sock is that an ineffective or partially effective bond is produced between the grout and the wall of the drilling. The strength of the reinforced structure could be improved if the seepage through the fabric sock were improved.

One answer to the above mentioned problem is to increase the injection pressure of the injected grout. However, increasing the injection pressure leads to an increased pressure in the drilling. There is then a risk of damaging the structure to be reinforced when pressure is increased in the drilling, because the increased pressure may force the structure apart, particularly when the drilling is close to the surface of the structure. Another problem associated with increasing the pressure is that the sock, under pressure, acts like a rigid member which can distort the structure and cause undesirable internal stresses in the structure when the reinforcing takes place.

Another problem associated with the known technique mentioned above is that bubbles and pockets of air form in the grout when the reinforcing takes place. These bubbles and pockets result in a reinforced structure which is weaker than a structure having no bubbles or pockets.

A solution to the above problems was proposed by the present applicant and published in WO2007144595 published on 21 Dec. 2007, in which a technique similar to that of EP1152102 is described. In WO2007144595 a vacuum tube is inserted near to the open end of the drilling to assist the process. I was thought that this vacuum would allow complete filling of the drilling with grout. However it has been found that the positioning of the end of the vacuum tube, i.e. where the vacuum is initially generated, it critical to the success of the process, and in particular to ensuring that grout substantially fills the drilling at the end of the process, and therefore the above mentioned method has been improved.

SUMMARY OF THE INVENTION

According to the present invention there is provided a method of reinforcing a structure having an elongate hole, the hole having an open proximal end and a closed distal end, the method comprising the steps of;

inserting into the open end of the hole an elongate reinforcement core carrying over at least part of its length an expandable sock, introducing a settable liquid into the sock at a first pressure so as to cause expansion of the sock toward the wall of the hole, the sock being formed from a material which is permeable to the liquid so as to allow the liquid to seep through the sock, reducing the pressure in the hole by means of a vacuum tube, whilst said introducing step is taking place, to at least a second pressure lower than the first pressure so as to encourage the liquid to seep through the sock, to substantially fill the hole;

characterised in that the vacuum tube extends substantially into the distal quarter of the length of the closed hole.

Preferably the vacuum tube extends further away from the open end of the hole than the elongate reinforcement core.

Preferably the settable liquid is pumped into the core by means of a grout tube and the tube too extends into the distal quarter of the hole.

Preferably the vacuum tube extends within the sock and terminates beyond the sock and beyond the grout tube.

Preferably the first and second pressures cause a pressure differential between inside of the sock and the outside of the sock such as to cause flow of liquid from the inside the sock to the outside of the sock, but to inhibit pressure build-up in the sock and on the wall of the hole resulting from the first pressure.

Preferably the method includes the step of causing the removal of bubbles or pockets of air from the grout during its introduction into the hole.

Preferably the liquid is in the form of a cementitious grout.

Preferably the elongate reinforcement core is in the form of a single or multiple metal bars or rods.

Preferably the liquid/grout is forced into the hole under pressure along a grout tube to the closed end.

Preferably the first pressure is above atmospheric pressure and the second pressure is below atmospheric pressure.

Preferably a plate is provided at the surface of the structure to provide a closed cavity inside the hole to maintain a vacuum therein.

Preferably the hole is formed by drilling.

Thus in embodiments of the invention, in producing a vacuum within the drilling the seepage of the liquid or grout through the sock to make contact and bond with the wall of the drilling is increased along the whole length of the drilling. This results is increased strength of the reinforced structure when the liquid or grout has set because there is a better bond between the reinforcing core and the structure at the wall of the drilling and because the grout fills substantially the whole drilling. The overall internal pressure in the drilling is reduced during reinforcement also. Furthermore, the grout is encouraged to the closed end of the drilling by the vacuum.

BRIEF DESCRIPTION OF THE DRAWINGS FIGURES

An embodiment of the invention will now be described by way of example, with reference to the drawings, in which FIG. 1*a* shows apparatus for carrying out reinforcement of a building;

FIG. 1*b* shows a section through the apparatus shown in FIG. 1*a;*

DETAILED DESCRIPTION OF THE INVENTION

Figures 1A, 1B:
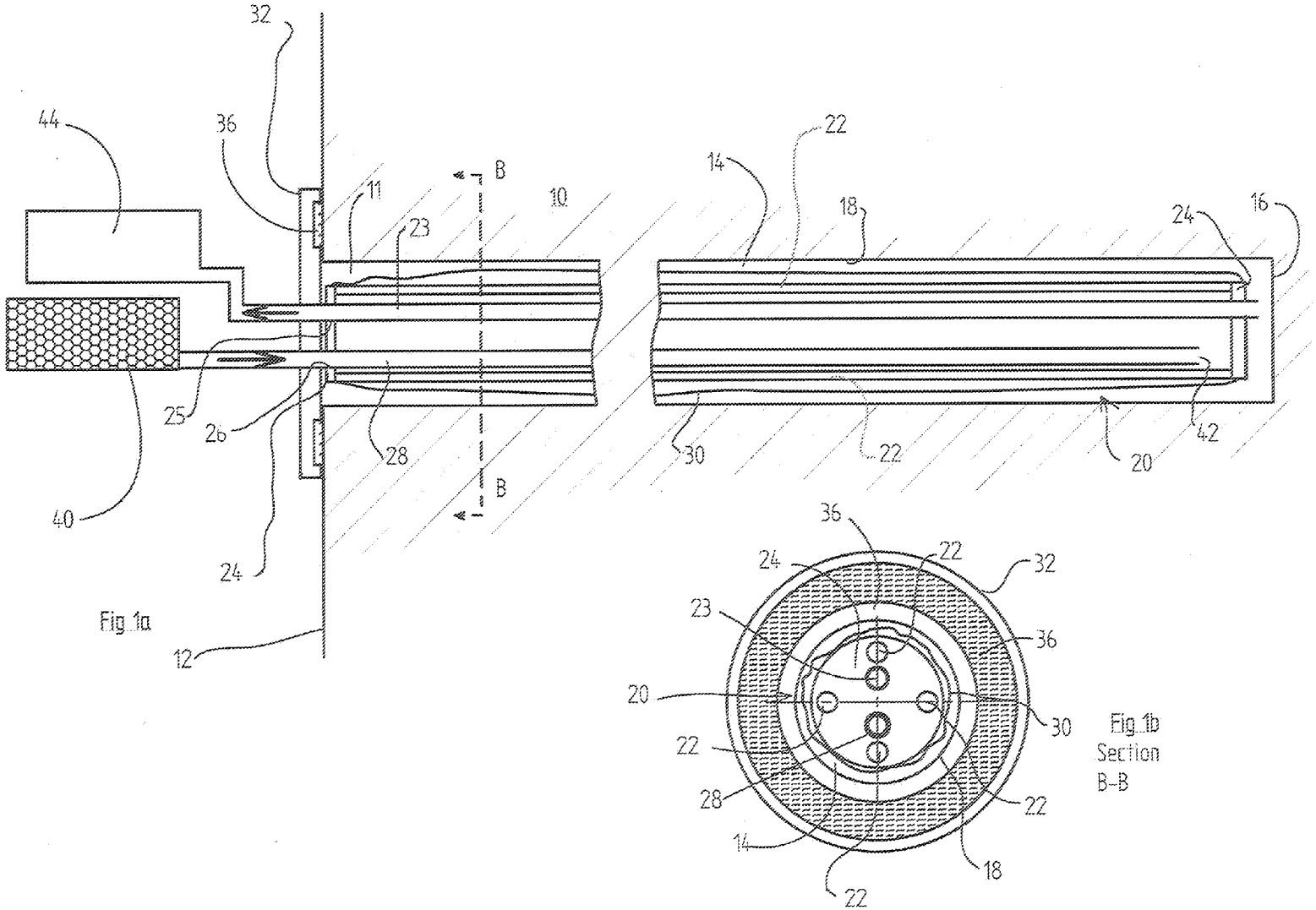

FIG. 1*a* shows a section through a building structure 10. This structure 10 is typically a wall, bridge arch, masonry, ornament or other structure which includes non man-made structures. Generally, such structures are produced from bricks, blocks, stone or other materials bonded together by mortar or the like. The structure is to be reinforced and has been drilled to produce an hole 14 by diamond drilling from a surface 12. The hole 14 has an open end 11 and terminates in this instance blindly at an opposite closed end 16. The hole 14 includes an inner wall surface 18.

In order to reinforce the structure a reinforcing core, shown generally at 20, is inserted into the hole 14 following drilling and cleaning of the hole 14.

Referring additionally to FIG. 1*b*, a section on plane B-B, through the reinforcing core 20 is shown in that Figure. The reinforcing core 20 includes four stainless steel reinforcing rods 22 held together by end plates 24. In this instance the end plates 24 are welded to the rods 22. The end plate 24 at the open end 11 of the hole includes also an aperture 26 which allows a grout tube 28 to pass therethrough, and includes a further aperture 25 which allows a vacuum tube 23 to pass therethrough. The reinforcing core 20 includes also a flexible fabric sock or sock 30 which loosely surrounds the reinforcing element and is secured to each end plate 24. The sock 30 is made of synthetic fibres woven into tubular form. The vacuum tube 23 extends further through the end plate 24 closest to the closed end of the hole 14 so that it is extends further into the closed hole than the reinforcing core 20.

In use the reinforcing core 20 is slid into the structure 10 along axis A together with tubes 28 and 23 located within the core 20 and the sock 30. A sealing plate 32 is then positioned over the hole 14 and tubes 28 and 23 extend through the sealing plate 32. The sealing plate 32 includes an elastomeric seal 36 which provides a substantially airtight seal around the opening 11 of the hole 14 at the surface 12.

Once the reinforcing core 20 is located within the hole 14 and the sealing plate 32 has been fitted, cementitious grout 40 is pumped under a pressure of approximately 150 to 450 KPa (preferably about 300 KPa) along tube 28 to the far end 16 of the hole 14. The grout emerges from the tube 28 at its end 42 and fills the sock 30 so that the sock expands, eventually to make contact with the wall 18 of the hole 14. At the same time a vacuum pump 44 is used to evacuate hole 14 via the vacuum tube 23 (i.e. reduce its pressure below atmospheric pressure). The evacuation of the hole 14 improves the seepage of the grout 40 through the fabric of the sock 30 and inhibits an undesirable build-up of pressure in the hole. The vacuum generated at the closed end of the hole 14 has been found to encourage grout to completely fill the hole 14.

Figure 2:
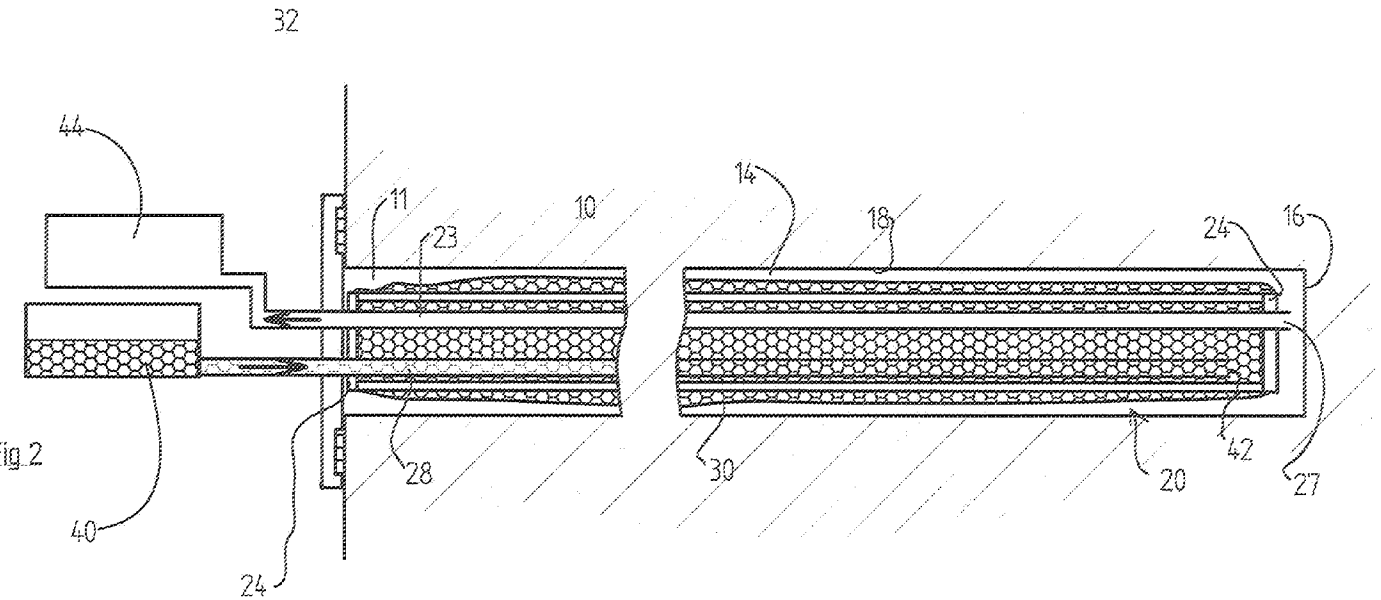
FIGS. 2 and 3 show further stages of the reinforcement.

FIG. 2 shows the sock 30 partially expanded by grout 40 as the grout 40 is forced into the hole 14 via the tube 28 and as the vacuum assists that process. It will be noted that the end 27 of the vacuum tube 22 extends beyond the end plate 24 of the reinforcement 20 and beyond the uninflated sock 30 when the open end 11 of the hole 14 is taken as a starting point. The positioning of the end 27 at the closed end encourages grout 40 to move to completely fill the hole.

Figure 3:
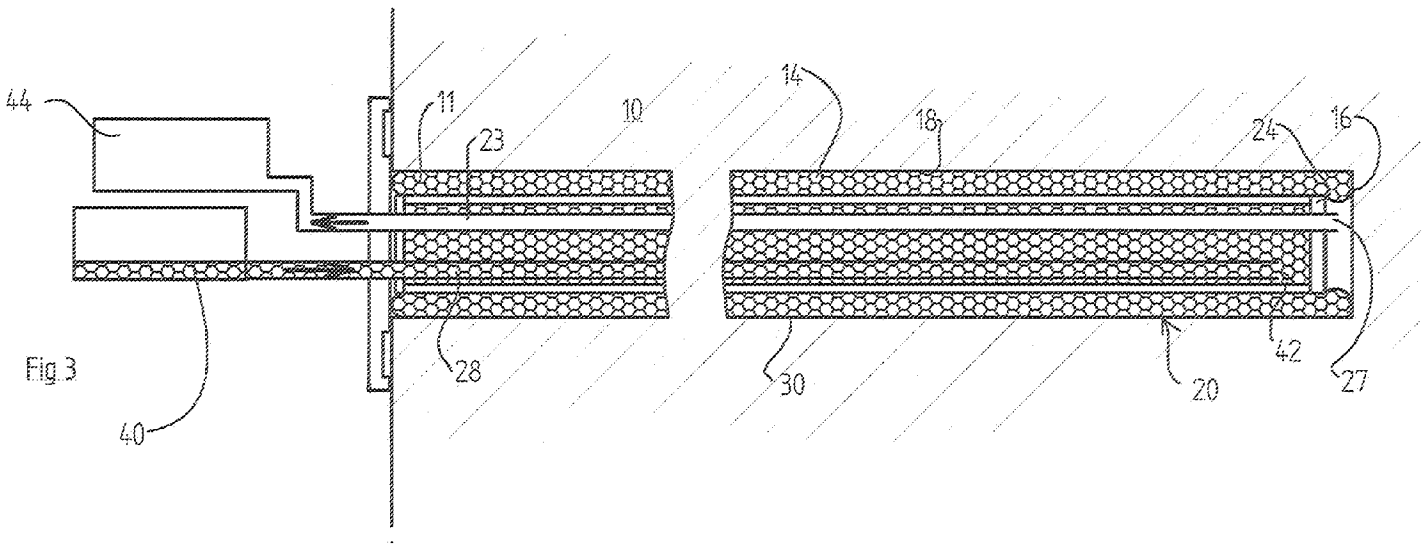

FIG. 3 shows the latter stages of the grout injection. The sock 30 has expanded to contact the whole wall 18 such that the sock 30 has expanded fully to the extent of the hole 14. At this stage the grout injection 28 may be removed or left in situ. Sealing plate 32 along with vacuum tube 36 may be removed also.

Figure 4:
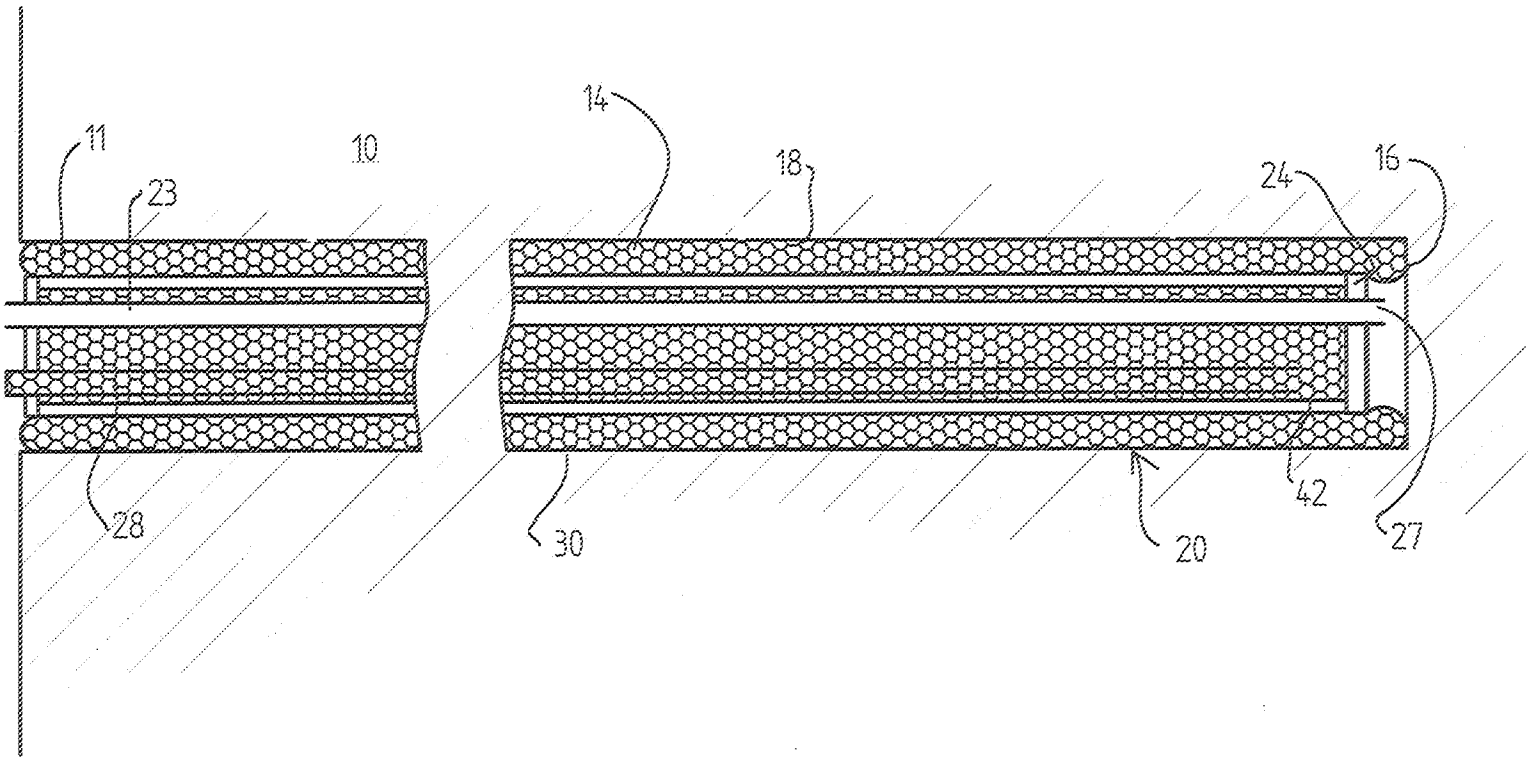
FIG. 4 shows a finished reinforcement.

FIG. 4 shows the finished, reinforced, structure with the reinforcing core 20 grouted in position and fixedly secured to the side wall 18 of the hole 14 by means of the grout 40 which has made superior contact with the whole of the wall 18 as a result of the evacuation of the hole 14 at its closed end during the application of the grout into the hole 14. It will be noted that in this instance the grout tube 28 and vacuum tube 23 have been left in place.

Various modifications or alternatives to the embodiment described above will be apparent to the skilled addressee. In particular, other materials than those described may be used. The cementitious grout may be replaced with any other settable material for example a polymer material. The bars 22 of the core 20 could be replaced by any number of bars including a single, possibly central, bar and the reinforcing core may project from the surface 12 once it has been inserted e.g. to provide a threaded anchor. The grout insertion tube 28 and vacuum tube 23 may be positioned as shown in the drawings i.e. adjacent the closed end of the hole 14, however, reasonable results can be obtained if the two tubes have ends which lie anywhere in the distal quarter of the closed hole to provide effective application of the grout and effective evacuation. It is important that the vacuum tube ends closer to the closed end of the hole than the grout tube. The vacuum tube may be formed integrally with the reinforcement core as shown or may be separate and may lie outside the core and sock. In practice it is likely that the vacuum tube may be filled with grout etc. and therefore it is possible that such grout may be recycled and pumped back into the hole in a closed circuit. More advantageously, a grout pump may be provided which also acts as a vacuum generating means and in such an instance may be connected to the vacuum tube 23. A blind hole has been described but this includes a through-hole which has had one end blocked-up or stopped. In the Figures a shortened reinforcement bar 20 has been illustrated, although in practice the bar can be many meters long and may be fittable into a 50-100 mm diameter hole.

The invention claimed is:

1. A method of reinforcing a structure having an elongate hole, the hole having an open proximal end and a closed distal end, the method comprising the steps of; inserting into the open end of the hole an elongate reinforcement core carrying over at least part of its length an expandable sock, introducing a settable liquid into the sock at a first pressure so as to cause expansion of the sock toward the wall of the hole, the sock being formed from a material which is permeable to the liquid so as to allow the liquid to seep through the sock, reducing the pressure in the hole by means of a vacuum tube, whilst said introducing step is taking place, to at least a second pressure lower than the first pressure so as to encourage the liquid to seep through the sock, to substantially fill the hole; characterised in that the vacuum tube extends substantially into the distal quarter of the length of the closed hole.

2. A method as claimed in claim 1, wherein the vacuum tube extends further away from the open end of the hole than the elongate reinforcement core.

3. A method as claimed in claim 1, wherein the settable liquid is pumped into the core by means of a grout tube and the tube too extends into the distal quarter of the hole.

4. A method as claimed in claim 3, wherein the vacuum tube extends within the sock and terminates beyond the sock and beyond the grout tube.

5. A method as claimed in any one of the preceding claims, wherein the first and second pressures cause a pressure differential between inside of the sock and the outside of the sock such as to cause flow of liquid from the inside the sock to the outside of the sock, but to inhibit pressure build-up in the sock and on the wall of the hole resulting from the first pressure.

6. A method as claimed in claim 1, wherein the method includes the step of causing the removal of bubbles or pockets of air from the liquid during its introduction into the hole.

7. A method as claimed in claim 1, wherein the liquid is in the form of a cementitious grout.

8. A method as claimed in claim 1, wherein the elongate reinforcement core is in the form of a single or multiple metal bars or rods.

9. A method as claimed in claim 3, wherein the liquid/grout is forced into the hole under pressure along a grout tube to the closed end.

10. A method as claimed in claim 1, wherein the first pressure is above atmospheric pressure and the second pressure is below atmospheric pressure.

11. A method as claimed in claim 1, wherein a plate is provided at the surface of the structure to provide a closed cavity inside the hole to maintain a vacuum therein.

12. A method as claimed in claim 1, wherein the hole is formed by drilling.

13. A method as claimed in claim 2, wherein the settable liquid is pumped into the core by means of a grout tube and the tube too extends into the distal quarter of the hole.

* * * * *